US010563358B2

(12) United States Patent
Hoefler

(10) Patent No.: US 10,563,358 B2
(45) Date of Patent: Feb. 18, 2020

(54) TAMPING UNIT

(71) Applicant: PLASSER & THEURER EXPORT VON BAHNBAUMASCHINEN GESELLSCHAFT M.B.H., Vienna (AT)

(72) Inventor: Florian Hoefler, Rohrbach (AT)

(73) Assignee: PLASSSER & THEURER EXPORT VON BAHNBAUMASCHINEN GESELLSCHAFT M.B.H., Vienna (AT)

( * ) Notice: Subject to any disclaimer, the term of this patent is extended or adjusted under 35 U.S.C. 154(b) by 212 days.

(21) Appl. No.: 15/744,465

(22) PCT Filed: Jul. 22, 2016

(86) PCT No.: PCT/EP2016/001281

§ 371 (c)(1),
(2) Date: Jan. 12, 2018

(87) PCT Pub. No.: WO2017/032436

PCT Pub. Date: Mar. 2, 2017

(65) Prior Publication Data

US 2018/0202113 A1 Jul. 19, 2018

(30) Foreign Application Priority Data

Aug. 21, 2015 (AT) ..... 555/2015

(51) Int. Cl.
*E01B 27/16* (2006.01)

(52) U.S. Cl.
CPC ..... *E01B 27/16* (2013.01)

(58) Field of Classification Search
CPC ..... E01B 27/16
USPC ..... 104/12
See application file for complete search history.

(56) References Cited

U.S. PATENT DOCUMENTS 3,000,327 A * 9/1961 Plasser et al. ..... E01B 27/16 104/12
3,653,327 A * 4/1972 Sauterel ..... E01B 27/16 104/12
3,669,025 A * 6/1972 Plasser ..... E01B 27/17 104/12
3,981,247 A * 9/1976 Theurer ..... E01B 27/16 104/12
4,068,595 A * 1/1978 Weber ..... B06B 1/18 104/12

(Continued)

FOREIGN PATENT DOCUMENTS

AT 339358 B 10/1977
DE 830352 C 2/1952
EP 0 331 956 A2 2/1989

OTHER PUBLICATIONS

International Search Report of PCT/EP2016/001281, dated Oct. 17, 2016.

*Primary Examiner* — Jason C Smith
(74) *Attorney, Agent, or Firm* — Collard & Roe, P.C.

(57) ABSTRACT

Two squeezing drives, each connected via a joint to a tamping tine of a tamping unit, are connected to one another—unchangeably with regard to their position relative one another—to form a drive unit. The latter has a sliding bearing, situated between the two joints, which is freely movable in vertical direction in a bearing guide connected to the tine carrier.

3 Claims, 1 Drawing Sheet

(56) References Cited

U.S. PATENT DOCUMENTS

| | | | | | |
|---|---|---|---|---|---|
| 4,218,978 | A * | 8/1980 | Pasquini | E01B 27/16 | 104/10 |
| 4,240,352 | A * | 12/1980 | Theurer | E01B 27/16 | 104/12 |
| 4,404,913 | A * | 9/1983 | Theurer | E01B 27/16 | 104/12 |
| 4,445,437 | A * | 5/1984 | Nielsen | E01B 27/16 | 104/12 |
| 4,942,821 | A * | 7/1990 | Rossanigo | E01B 27/16 | 104/12 |
| 2017/0348731 | A1* | 12/2017 | Hoefler | E01B 27/16 | |
| 2018/0202113 | A1* | 7/2018 | Hoefler | E01B 27/16 | |

* cited by examiner

Fig. 1
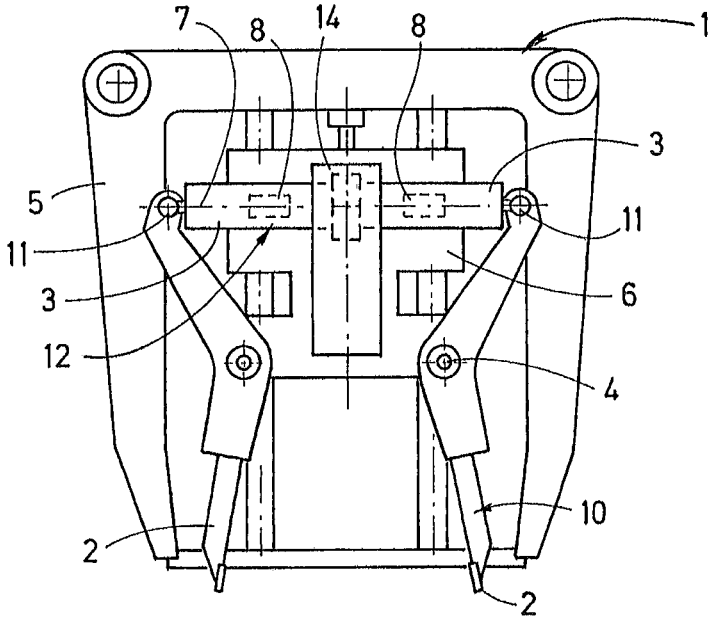
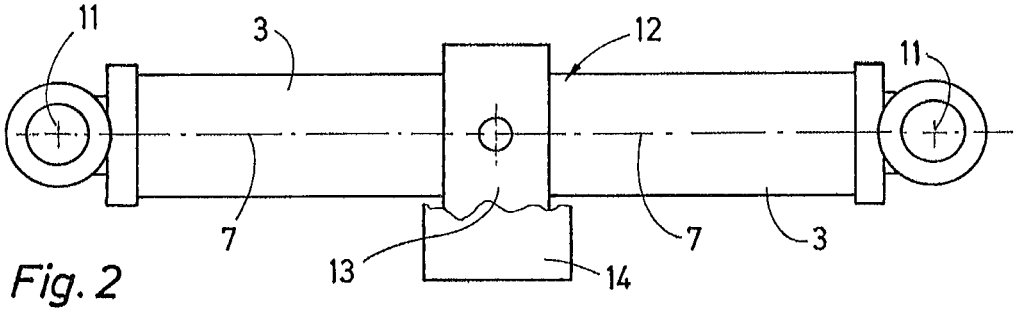
Fig. 2
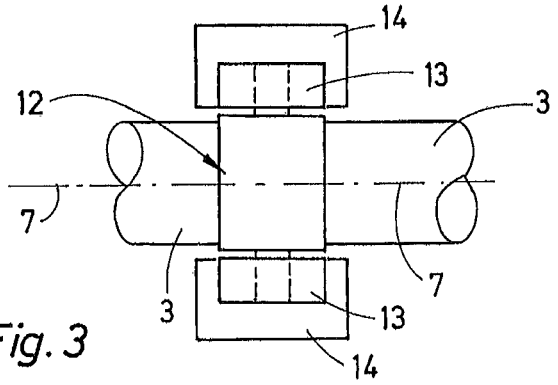
Fig. 3

TAMPING UNIT

CROSS REFERENCE TO RELATED APPLICATIONS

This application is the National Stage of PCT/EP2016/001281 filed on Jul. 22, 2016, which claims priority under 35 U.S.C. § 119 of Austrian Application No. A 555/2015 filed on Aug. 21, 2015, the disclosures of which are incorporated by reference. The international application under PCT article 21(2) was not published in English.

The invention relates to a tamping unit for tamping sleepers of a track, including a tine carrier, supported for vertical adjustment on an assembly frame, on which tamping tines forming a tamping tine pair are mounted, the tamping tines being pivotable towards one another in each case by means of a hydraulic squeezing cylinder which has a cylinder axis and is connected to a vibration exciter.

Tamping units for tamping sleepers of a track are already widely known, for example from U.S. Pat. No. 4,240,352, AT 339 358, EP 0 331 956 or U.S. Pat. No. 4,068,595. The vibrations of the vibration exciter acting upon the tamping tines can be produced either by an eccentric shaft or by hydraulic impulses in a linear drive that simultaneously also carries out the squeezing motions of the tamping tines.

It is the object of the present invention to provide a tamping unit of the type mentioned at the beginning with which it is possible to realize a reduction of the vibratory stress on the assembly frame.

According to the invention, this object is achieved with a tamping unit of the specified kind by way of the features cited in the characterizing part of the main claim.

With this connection of the two squeezing cylinders to form a rigid structural unit, the particular advantage is attained that the vibrations of the two squeezing cylinders produced by the vibration exciter largely cancel out one another. The vertically adjustable slide bearing ensures a problem-free squeezing motion of the tamping tines.

Additional advantages of the invention become apparent from the dependent claims and the drawing description.

The invention will be described in more detail below with reference to an embodiment represented in the drawing.

FIG. 1 shows a side view of a tamping unit having squeezing drives designed to move tamping tines towards one another, and FIGS. 2, 3 each show an enlarged representation of the squeezing drives.

A tamping unit 1, shown in FIG. 1, for tamping sleepers of a track has two tamping tines 2, forming a tamping tine pair 10, which—with the aid of a respective squeezing drive 3—are movable towards one another in tong-like fashion for ballast consolidation. Each tamping tine 2 is mounted for pivoting about a pivot axis 4 on a tine carrier 6 which is vertically adjustable relative to an assembly frame 5. Associated with each squeezing drive 3 having a cylinder axis 7 is a hydraulic-based vibration exciter 8 for producing vibrations superimposed on a squeezing motion of the tamping tines 2.

As visible particularly in FIGS. 2 and 3, the two squeezing drives 3 of the tamping tine pair 10, each connected via a joint 11 to one of the two tamping tines 2, are connected to one another—unchangeably with regard to their position relative to one another—to form a drive unit 12. The latter has a sliding bearing 13, situated between the two joints 11, which is freely movable in vertical direction in a bearing guide 14 connected to the tine carrier 6.

The cylinder axes 7 of the two connected squeezing cylinders 3 are arranged in a common line or coaxially. The sliding bearing 13 is positioned centrally between the two joints 11.

In an alternate solution of the invention, it would also be possible, particularly for reasons of space, to arrange the cylinder axes 7 of the two squeezing drives 3 at a slight angle to one another.

The invention claimed is:

1. A tamping unit for tamping sleepers of a track comprising:

an assembly frame (5);

a tine carrier (6), supported for vertical adjustment on said assembly frame, at least one tamping tine pair (10) comprising tamping tines (2) mounted on said tine carrier (6), a drive unit (12) comprising:

i) a plurality of hydraulic squeezing cylinders (3) with a first hydraulic squeezing cylinder (3) being coupled to a first tamping tine (2) at an articulation point (11) and a second hydraulic squeezing cylinder being coupled to a second tamping tine at an articulation point wherein the tamping tines are pivotable towards one another in each case by means of each hydraulic squeezing cylinder (3) which is movable along a cylinder axis (7);

ii) a hydraulic vibration exciter (8) coupled to at least one of said plurality of hydraulic squeezing cylinders (3);

wherein said hydraulic squeezing cylinders (3) are connected to one another;

a bearing guide (14) coupled to said tine carrier;

a sliding bearing (13) coupled to the drive unit, situated between the two articulation points (11), which is freely movable in vertical direction in said bearing guide (14) connected to the tine carrier (6).

2. The tamping unit according to claim 1, wherein the cylinder axes of the two connected squeezing drives are arranged coaxially.

3. The tamping unit according to claim 1, wherein the sliding bearing is arranged centrally between the two joints.

* * * * *